US006823554B1

(12) United States Patent
Braun et al.

(10) Patent No.: US 6,823,554 B1
(45) Date of Patent: Nov. 30, 2004

(54) ORAL DEVICES

(75) Inventors: Phillip M. Braun, Exeter, RI (US); Amit Birla, Mansfield, MA (US); Ronald R. Duff, Shrewsbury, MA (US); Karen Claire, Menlo Park, CA (US)

(73) Assignee: Gillette Canada Company, Halifax ( * ) Notice: Subject to any disclaimer, the term of this patent is extended or adjusted under 35 U.S.C. 154(b) by 353 days.

(21) Appl. No.: 09/680,007

(22) Filed: Oct. 5, 2000

(51) Int. Cl.[7] ..... A46B 9/04

(52) U.S. Cl. ..... 15/167.2; 15/167.1; 15/143.1

(58) Field of Search ..... 15/167.1, 167.2, 15/143.1, 207.2

(56) References Cited

U.S. PATENT DOCUMENTS

| | | | | |
|---|---|---|---|---|
| 388,620 A | | 8/1888 | Booth | |
| 486,112 A | | 11/1892 | Kuns | |
| 511,619 A | | 12/1893 | Ivory | |
| 1,188,134 A | | 6/1916 | Arbat | |
| 1,544,404 A | | 6/1925 | Hummel | |
| 1,593,763 A | | 7/1926 | Henderson | |
| 1,693,229 A | | 11/1928 | Felmar | |
| 1,758,632 A | | 5/1930 | Wagner | |
| 1,908,509 A | * | 5/1933 | Davis | 15/167.2 |
| 1,967,783 A | | 7/1934 | Rudof | |
| 2,066,241 A | * | 12/1936 | Trattner et al. | 15/167.2 |
| 2,077,392 A | | 4/1937 | Boyd | |
| 2,093,007 A | | 9/1937 | Chott | |
| 2,093,383 A | | 9/1937 | Rudof et al. | |
| 2,175,975 A | | 10/1939 | Steiner | |
| 2,220,053 A | | 10/1940 | Pruner | |
| 2,246,867 A | | 6/1941 | Thomas et al. | |
| 2,583,886 A | | 1/1952 | Schlegel | |
| 2,628,377 A | | 2/1953 | Cockriel | |
| 2,655,674 A | | 10/1953 | Grover | |
| 2,655,676 A | | 10/1953 | Grover | |
| 2,701,380 A | | 2/1955 | Ripper | |
| 2,771,624 A | * | 11/1956 | Ripper | 15/167.2 |
| 2,935,755 A | | 5/1960 | Leira et al. | |
| 3,082,457 A | | 3/1963 | Lucibello et al. | |
| 3,386,118 A | | 6/1968 | Morioku et al. | |
| 3,646,628 A | | 3/1972 | Halford | |
| 3,683,442 A | | 8/1972 | Holly | |
| 3,722,020 A | | 3/1973 | Hills | |
| 3,903,906 A | | 9/1975 | Collis | |
| 3,984,890 A | | 10/1976 | Collis | |
| 4,317,463 A | | 3/1982 | Massetti | |
| 4,428,091 A | | 1/1984 | Janssen | |
| 4,449,266 A | * | 5/1984 | Northemann et al. | 15/167.2 |
| 4,449,933 A | | 5/1984 | Forni | |
| 4,454,623 A | * | 6/1984 | O'Halloran | 15/167.1 |
| 4,519,111 A | * | 5/1985 | Cavazza | 15/167.1 |
| 4,534,081 A | | 8/1985 | Spademan | |
| 4,573,920 A | | 3/1986 | d'Argembeau | |
| 4,625,357 A | | 12/1986 | DeMartino | |
| 4,679,273 A | * | 7/1987 | Okin | 15/167.1 |
| 4,694,844 A | | 9/1987 | Berl et al. | |

(List continued on next page.)

FOREIGN PATENT DOCUMENTS

| | | | |
|---|---|---|---|
| DE | 4115943 | 11/1991 | A46B/9/04 |
| DE | 19708875 | 5/1998 | A61C/17/00 |
| EP | 0 520 985 B1 | 8/1997 | |

*Primary Examiner*—Robert J. Warden, Sr.
*Assistant Examiner*—S Balsis
(74) *Attorney, Agent, or Firm*—Fish & Richardson P.C.

(57) ABSTRACT

An oral device is provided that includes a handle, a head, extending from the handle and having a pair of elongated arms that include opposed surfaces; and a pair of opposed cleaning elements, mounted on the opposed surfaces, the cleaning elements being constructed and positioned to be inserting into the interproximal regions of a user's mouth when the oral is moved back and forth over the user's teeth. Each of the cleaning elements are positioned at an acute angle with respect to an interproximal line defined through the interproximal region.

57 Claims, 8 Drawing Sheets

U.S. PATENT DOCUMENTS 4,712,266 A 12/1987 Yamaki
4,757,570 A 7/1988 Haeusser et al.
4,796,325 A 1/1989 Bortman
4,876,157 A * 10/1989 Barman ..... 428/542.8
4,911,187 A 3/1990 Castillo
4,979,256 A 12/1990 Branford
5,027,463 A 7/1991 Daub
5,032,082 A 7/1991 Herrera
5,072,481 A 12/1991 Frank Weyer
5,120,225 A 6/1992 Amit
5,175,901 A 1/1993 Rabinowitz
5,184,368 A 2/1993 Holland
5,186,627 A 2/1993 Amit et al.
5,284,168 A 2/1994 Klinkhammer
5,305,491 A * 4/1994 Hegemann ..... 15/167.2
5,342,284 A 8/1994 Lemon et al.
5,351,358 A 10/1994 Larrimore
5,398,369 A 3/1995 Heinzelman et al.
5,497,526 A 3/1996 Klinkhammer
5,537,708 A 7/1996 Luposello
5,546,626 A 8/1996 Chung
5,609,170 A 3/1997 Roth
5,623,746 A 4/1997 Ichiro
5,647,385 A 7/1997 Zebuhr
5,658,148 A 8/1997 Neuberger et al.
5,660,546 A 8/1997 Shafer
5,699,578 A 12/1997 Dumler et al.
5,758,380 A 6/1998 Vrignaud
5,765,249 A * 6/1998 Axelrod ..... 15/106
5,765,254 A * 6/1998 O'Halloran ..... 15/167.1
5,775,346 A 7/1998 Szyszkowski
5,802,656 A 9/1998 Dawson et al.
5,842,249 A 12/1998 Sato
5,930,860 A * 8/1999 Shipp ..... 15/110
6,065,176 A * 5/2000 Watanabe et al. ..... 15/167.1
6,067,684 A * 5/2000 Kweon ..... 15/167.1
6,178,583 B1 * 1/2001 Volpenhein ..... 15/167.1
6,185,779 B1 * 2/2001 Kramer ..... 15/167.1
6,397,425 B1 * 6/2002 Szczech et al. ..... 15/167.1

* cited by examiner

ORAL DEVICES

BACKGROUND OF THE INVENTION

The present invention relates to oral devices, e.g., devices for cleaning the teeth, gums and interproximal regions.

Conventional toothbrushes, having tufts of bristles mounted on a head, are generally effective at removing plaque from the flat surfaces of teeth and the areas between teeth and along the gumline that can be accessed by the bristles during brushing. However, such toothbrushes typically cannot clean interproximal and sub-gingival regions where tufts of bristles are generally unable to penetrate or reach. This is because the bristles tend to pass or flick over the gaps between the teeth and are usually physically impeded from reaching behind the interdental papillae and below the gumline. To clean the interproximal regions supra- and sub-gingivally, it is generally necessary to floss between the teeth with dental floss.

While flossing effectively cleans the interproximal and sub-gingival regions, many people do not floss regularly, or do not floss at all. Failing to floss regularly may result in gingivitis, which can lead to more serious gum diseases. These problems can occur despite regular toothbrushing.

SUMMARY OF THE INVENTION

The inventors have found that interproximal penetration appears to occur more often and be deeper when a slow brushing movement is used, slower than many people typically brush their teeth. The present invention features an oral device that is designed to be used with a slow, ratcheting motion, to allow the device to penetrate between the teeth on both sides of each tooth and "pry out" trapped food and debris that are lodged in the interproximal regions. Preferred oral devices of the invention provide deep interproximal penetration and effective removal of food and debris.

The inventors have also discovered that there is a correlation between interproximal penetration and the angle of a bristle relative to a line drawn through the interproximal region ("the interproximal line"), substantially parallel to the opposed surfaces of the teeth. If the bristle is parallel to the interproximal line when the device is placed over the teeth (defined as a 0 degree angle), less interproximal.penetration occurs than if the bristle is angled away from the interproximal line. In preferred oral devices, the cleaning elements of the device (e.g., bristles or fins) are angled away from the interproximal line, more preferably at least 10 degrees and most preferably at least 15 degrees.

In one aspect, the invention features an oral device that includes a handle, a head, extending from the handle and having a pair of elongated arms that include opposed surfaces; and a pair of opposed cleaning elements, mounted on the opposed surfaces, the cleaning elements being constructed and positioned to be inserted into the interproximal regions of a user's mouth when the oral device is moved back and forth. Each of the cleaning elements are positioned at an acute angle with respect to the interproximal line.

In preferred embodiments, the oral device includes one or more of the following features. The cleaning elements are positioned to be flexed towards the opposed arms during movement in a first direction, and then straighten out until they are substantially perpendicular to the opposed surfaces during movement in a second, opposite direction. The device includes a plurality of pairs of cleaning elements, and each of the cleaning elements extends at substantially the same angle, with respect to the interproximal line, as the other cleaning elements on the same surface. The angle is greater than 10 degrees, preferably greater than 15 degrees, more preferably from about 15 to 40 degrees and most preferably about 15 to 30 degrees. The opposed cleaning elements define a V shape. The device includes at least 2 pairs of cleaning elements, the pairs of cleaning elements being positioned along the opposed surfaces at predetermined intervals. The pairs of cleaning elements extend from the handle towards the opposite end of the head in a row. The cleaning elements are progressively shorter as the pairs are spaced further from the handle. The cleaning elements of each pair are from 2 to 20% shorter than the cleaning elements of an adjacent pair that is closer to the handle. The handle includes a gripping portion that is constructed to be grasped between the thumb and first two fingers of a user's hand. The handle includes a substantially disc-shaped gripping portion. The handle includes an elongated shaft, the head is mounted at a first end of the elongated shaft, and the gripping portion is mounted at a second end of the elongated shaft. The head further comprises a web extending from the handle, and the opposed arms extend outwardly from opposite sides of the web. The web defines a substantially U-shaped opening that faces away from the handle. The device includes a plurality of pairs of centering elements, positioned on the opposed surfaces between the cleaning elements and the web, for guiding the oral device. The centering elements are positioned so that, in use, at least two centering elements on each side are touching the teeth simultaneously. The centering elements comprise elastomeric elements and/or bristle tufts. The centering elements are mounted substantially parallel to the interproximal line. Adjacent pairs of cleaning elements are spaced from 0.5 to 6.0 mm apart along the length of the arms. The cleaning elements comprise bristle tufts and/or elastomeric fins. At least some of the cleaning elements comprise inner, relatively longer thin bristles and outer, relatively shorter and thicker supporting bristles. The bristles have a diameter of from about 0.003 inch to 0.009 inch.

In another aspect, the invention features an oral device that includes: (a) a handle that includes a gripping portion constructed to be grasped between the thumb and first two fingers of a user's hand; (b) a head, extending from the handle, having a pair of elongated arms that include opposed surfaces; and (c) pairs of opposed cleaning elements, mounted on the opposed surfaces, the pairs of cleaning elements being positioned along the opposed surfaces at predetermined intervals for insertion into the user's interproximal regions.

Preferred embodiments include one or more of the following features. The gripping portion is substantially disc-shaped. The gripping portion has a thickness of from about 0.5 to 20 mm. The gripping portion has a diameter of from about 2 to 7 cm.

In a further aspect, the invention features a method of cleaning between the teeth of a human, including: (i) inserting into the mouth an oral device that includes (a) a handle having a first end constructed to be grasped by a user and a second, free end; (b) a head, positioned at the second end of the handle, having a pair of elongated arms, the arms being substantially parallel to each other and having opposed surfaces; and (c) pairs of opposed cleaning elements, mounted on the opposed surfaces, the pairs of cleaning elements being positioned along the opposed surfaces at predetermined intervals, the distance between pairs corresponding substantially to the average spacing between human teeth; (ii) positioning the oral device so that the opposed cleaning elements straddle a row of teeth; (iii) pushing the oral device toward the back of the mouth until each pair of opposed cleaning elements is positioned between two adjacent teeth; and (iv) pulling the oral device toward the front of the mouth, causing the cleaning elements to wedge into the interproximal region between the adjacent teeth. Preferably, steps (iii) and (iv) are performed with a motion that is slower than the user's normal toothbrushing speed.

In yet another aspect, the invention features an oral device that includes a handle, a head, extending from the handle, having a pair of elongated arms that include opposed surfaces, and pairs of opposed cleaning elements, mounted on the opposed surfaces, the pairs of cleaning elements being positioned along the opposed surfaces at predetermined intervals, the cleaning elements being constructed and positioned to be inserted into the user's interproximal regions when the oral device is moved back and forth with a ratcheting motion to index the device from one interproximal region to the next.

The term "opposed", as used herein, is not intended to require that the elements referred to have parallel surfaces, but merely to indicate that the elements generally face toward each other.

Other features and advantages of the invention will be apparent from the following description of a presently preferred embodiment, and from the claims.

DESCRIPTION OF THE PREFERRED EMBODIMENTS

Figure 1:
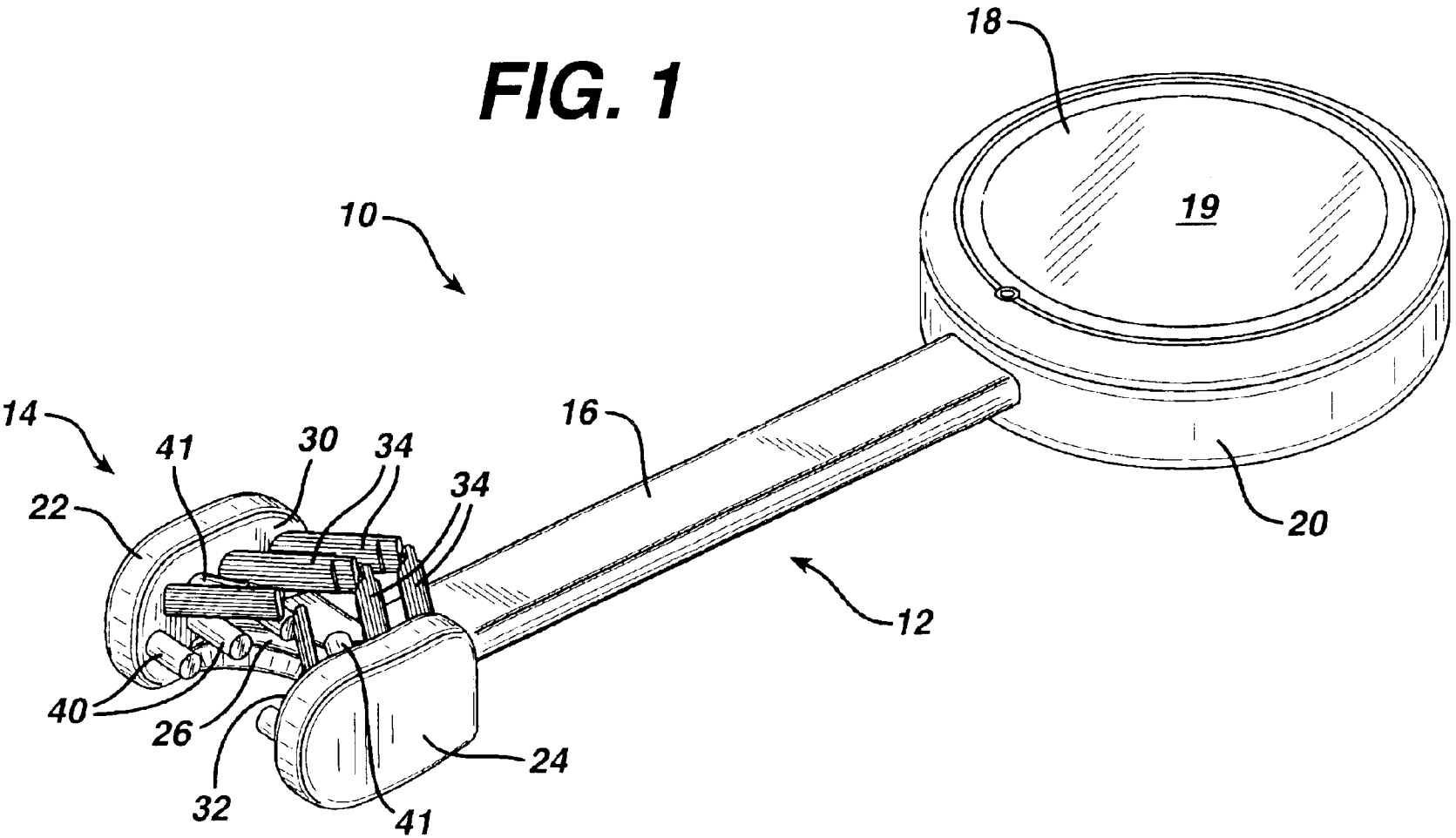
FIG. 1 is a perspective view of an oral device according to one embodiment of the invention.
Figure 2:
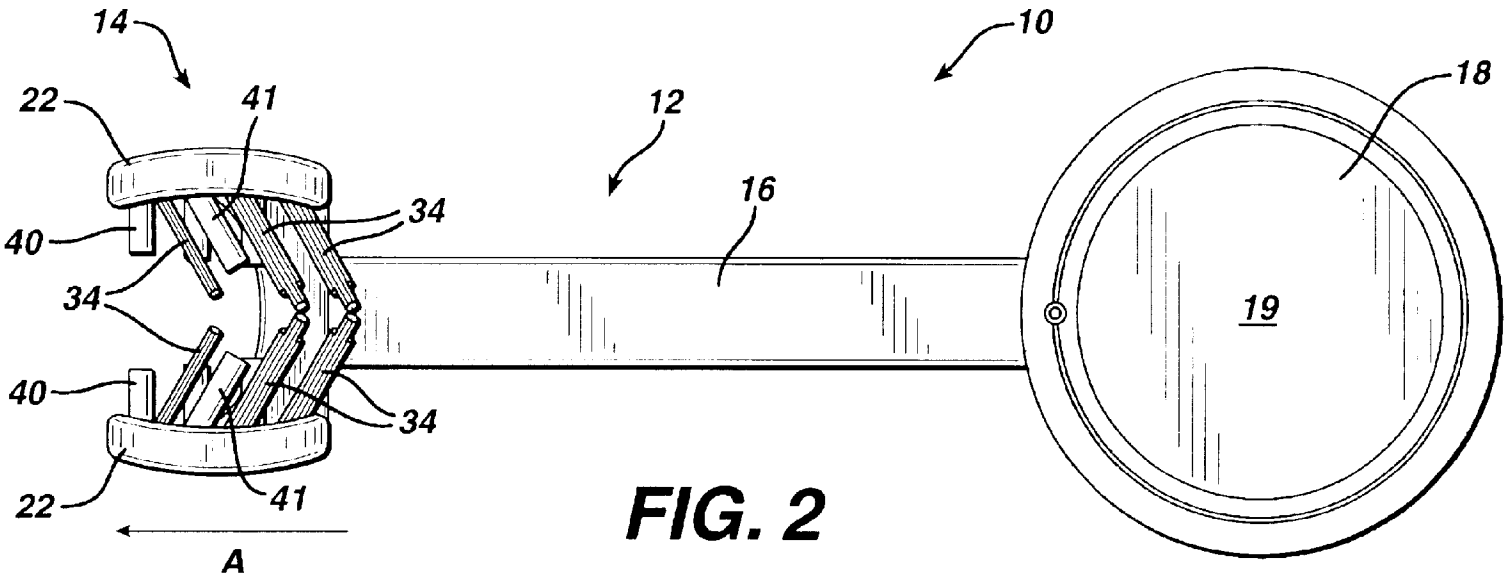
FIG. 2 is a top view of the oral device of FIG. 1.
Figure 3:
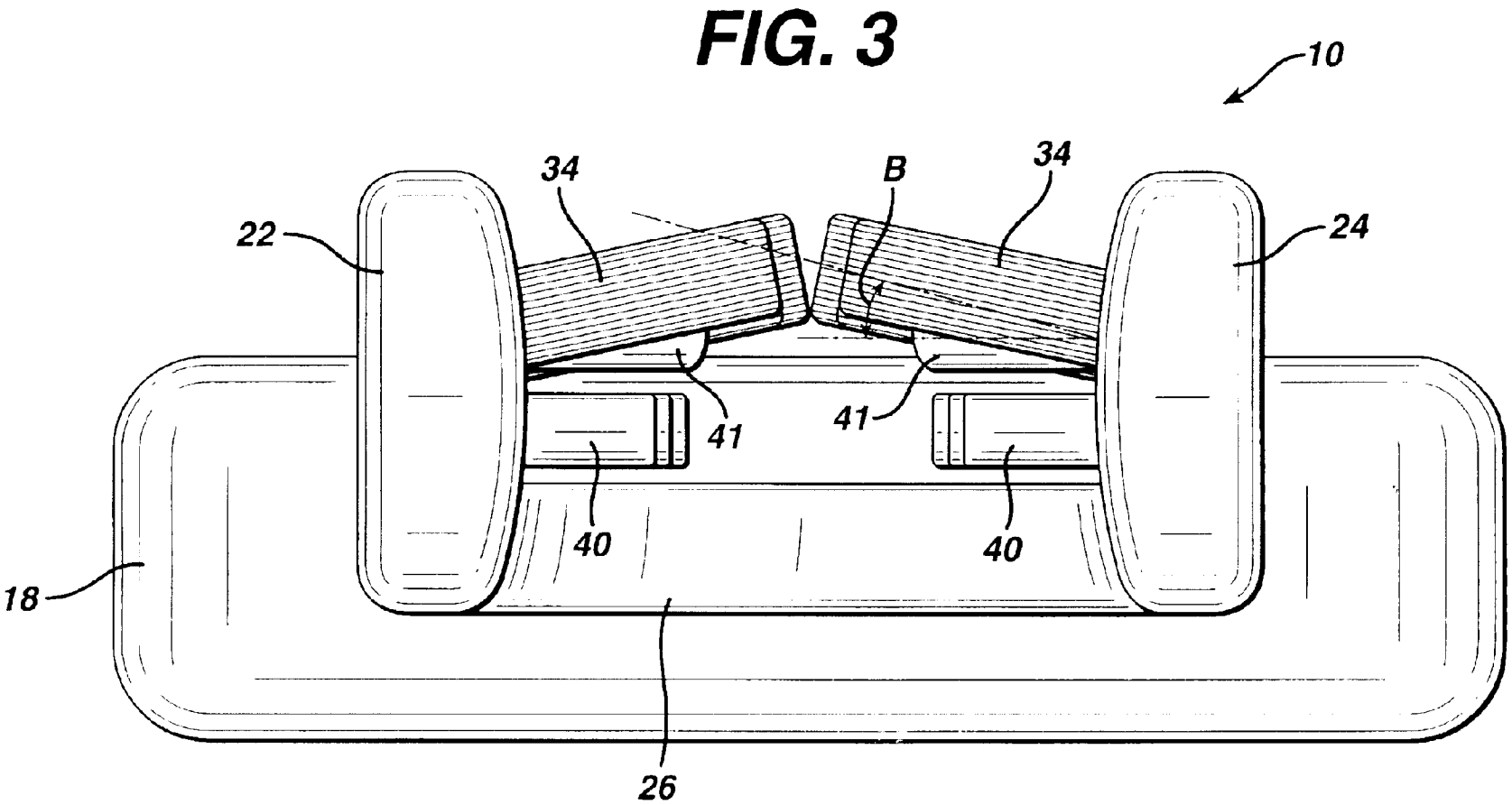
FIG. 3 is an end view of the oral device of FIG. 1.

A preferred oral device 10 is shown in FIGS. 1–3. Referring to FIG. 1, oral device 10 includes a handle 12 and a head 14 mounted at one end of the handle. Handle 12 includes a shaft 16 and a grip 18. The grip 18 is disc-shaped, having relatively large top and bottom surfaces 19 and a relatively thin side surface 20, so that a user will tend to grasp the top and bottom surfaces 19 of the disc between the thumb and index finger, or thumb and first two fingers, rather than holding the grip encircled by the palm and fingers as a conventional elongated toothbrush handle is typically held. Thus the grip 18 is held in a manner similar to the way a pen is usually held, giving the oral device the feel of a precision instrument and tending to cause the user to move the oral device slowly and deliberately, rather than with a rapid brushing motion. The shaft is generally from about 5 to 10 cm long, the diameter of the grip is from about 2 to 5 cm, and the thickness of the grip is from about 0.5 to 20 mm, more preferably 0.5 to 10 mm.

Figure 1A:
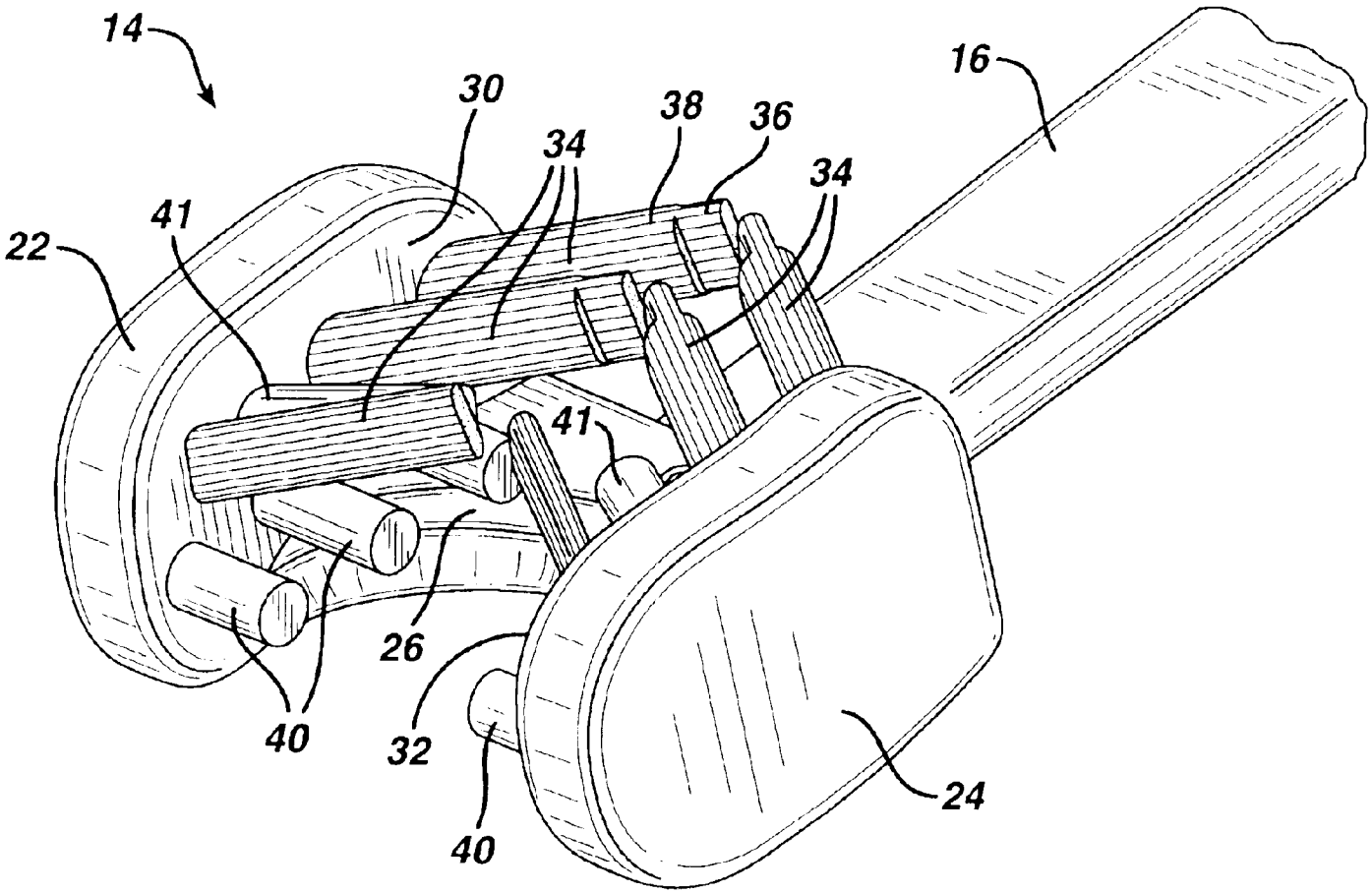
FIG. 1A is an enlarged detail view of the head of the oral device of FIG. 1.
Figure 1B:
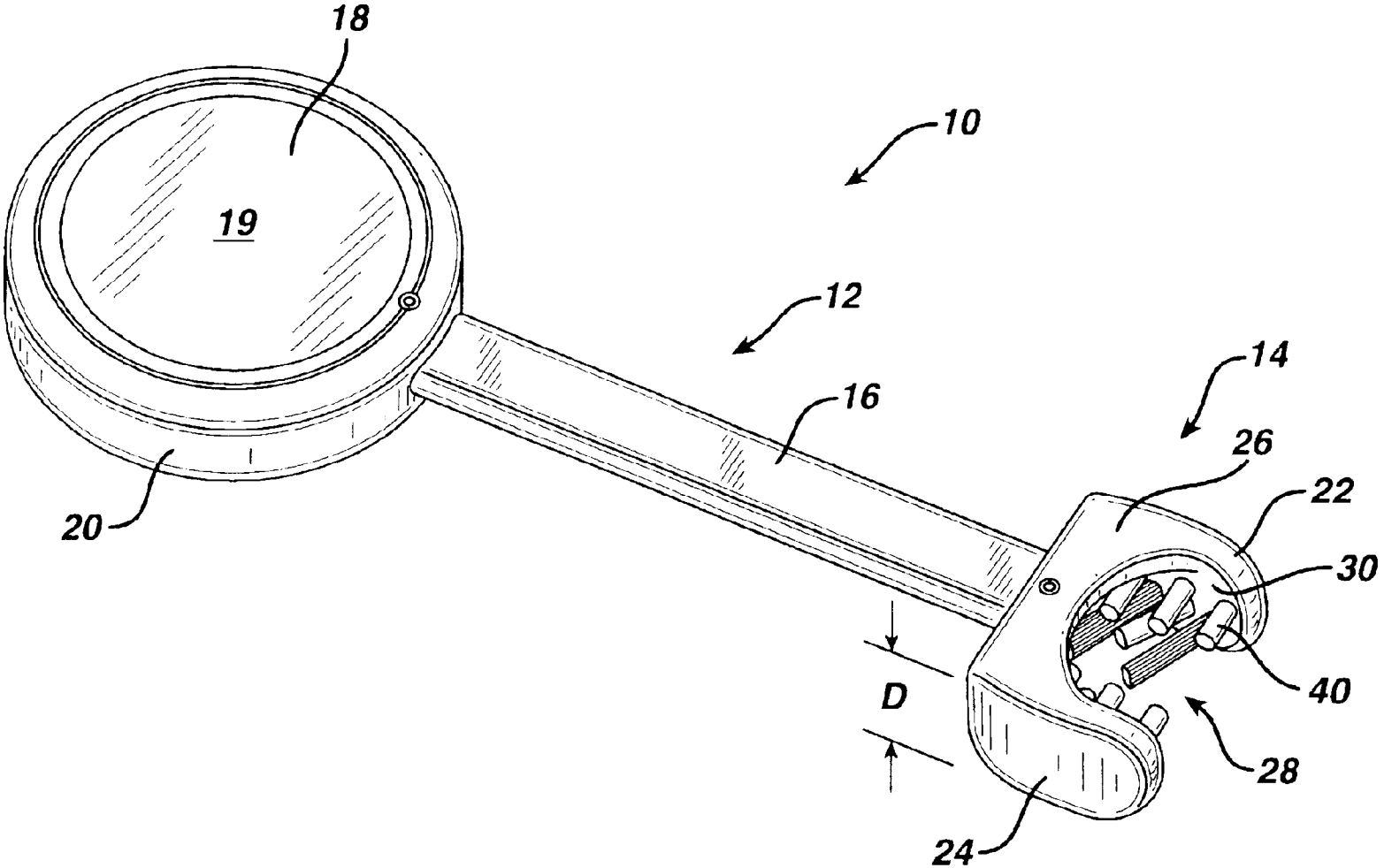
FIG. 1B is a perspective view of the oral device of FIG. 1, taken from the opposite direction.

The head 14, shown in more detail in FIGS. 1A and 1B, includes a pair of opposed arms 22, 24 that are connected by a web 26 that extends from the shaft 16. As shown in FIG. 1B, the web 26 includes a U-shaped opening 28 that facilitates maneuvering of the oral device in the mouth, as will be discussed in further detail below. Opposed arms 22, 24 include facing surfaces 30, 32, upon which pairs of opposed cleaning elements 34 are mounted. The opposed arms 22, 24 have a depth D (FIG. 1B) that is selected to allow the head to accommodate both the front and back teeth. Preferably, depth D is from about 5 to 15 mm.

Figure 4A:
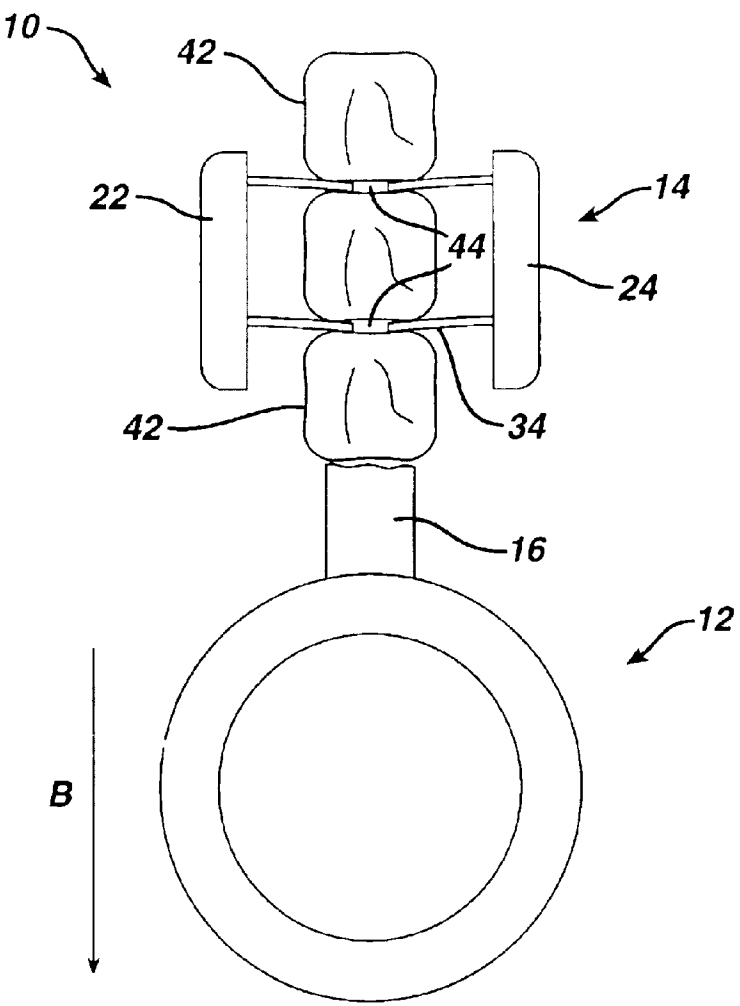
FIGS. 4 and 4A are schematic top views showing the oral device of FIG. 1 being used to clean between the teeth of a portion of the lower jaw. A portion of the oral device is cut-away (see broken lines) to show the underlying teeth.
Figure 4:
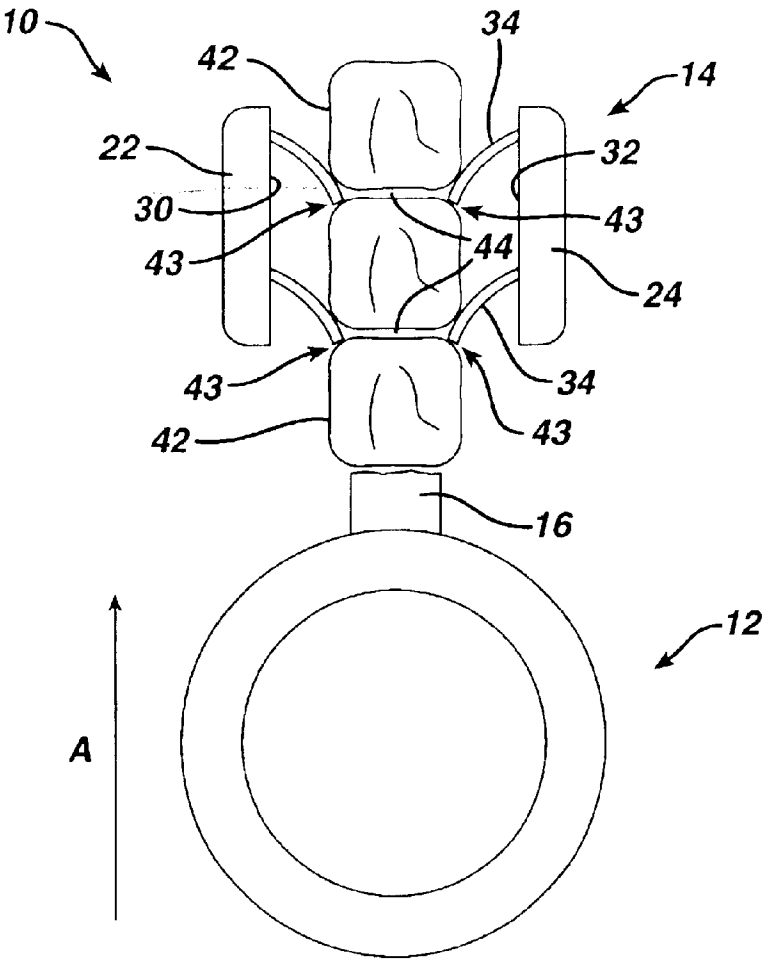

The oral device is shown in use in FIGS. 4–4A. These figures show, from above, the oral device "straddling" some of the teeth. A portion of the shaft 16 and head 12 have been cut away (see broken lines) in order to show the interaction of cleaning elements 34 with teeth 42. As shown in FIG. 4, the oral device is first placed over the teeth so that the cleaning elements 34 of each pair are positioned on opposite sides of the teeth, and the oral device is then pushed toward the back of the mouth (arrow A) to index the cleaning elements with the spaces 43 between adjacent teeth. At this point, the cleaning elements are flexed towards the opposed surfaces 30, 32 of arms 22, 24. Then, as shown in FIG. 4A, the oral device is slowly pulled forward, towards the front of the mouth (arrow B), causing the cleaning elements 34 to relax towards their normal positions, and then move beyond their normal positions, straightening out to penetrate into the interproximal regions 44. When the device is then pushed forward again, in the direction of arrow A, the cleaning elements are forced out of the interproximal regions 44, dislodging debris as they exit. This series of movements is repeated over and over, with the user slowly "ratcheting" the oral device back and forth while advancing the device from tooth to tooth, until all of the teeth and interproximal regions of one jaw have been cleaned. The device is then positioned so that it straddles the teeth of the other jaw, and the process is repeated to clean between the teeth of the other jaw. The U-shaped opening enhances user comfort and provides clearance of the jawbone in the rear of the mouth, thereby allowing better access to the furthest molars.

Figure 2A:
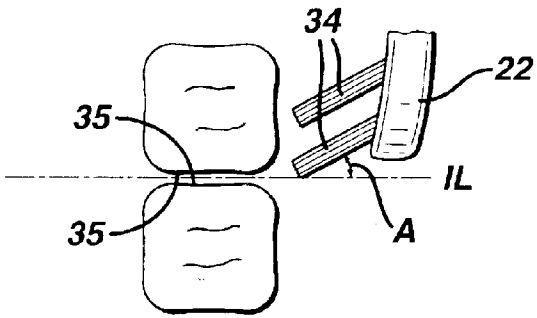
FIG. 2A is an enlarged detail view of a pair of cleaning elements positioned relative to the interproximal line.

The cleaning elements are mounted at an angle A (see FIG. 2A) so that the opposed elements define a V-shape, the base of the V pointing toward the grip 18. Thus, the cleaning elements are angled, with respect to a line drawn through the interproximal region substantially parallel to the opposed surfaces 35 of the teeth ("the Interproximal Line", IL, FIG. 2A) at an angle A, to enable the cleaning elements to penetrate the interproximal region during use. Angle A is preferably at least about 10 degrees, more preferably at least 15 degrees, and most preferably about 15 to 25 degrees. At smaller angles, the cleaning elements may not adequately penetrate the interproximal region, while at larger angles the cleaning elements may not engage between the teeth and will tend to bend over during use.

The cleaning elements are also angled away from web 26. This angle B (see FIG. 3), is preferably at least 5 degrees, more preferably from about 10 to 20 degrees. The elements are angled in this direction to compensate for the tendency of the cleaning elements to bend toward web 26 when the device is placed over the teeth. The resultant angle of the cleaning elements, in use, is typically 0–5 degrees. In some cases, if angle B is too small, the cleaning elements may bend towards the web (towards the top of the tooth) and may tend not to engage into the gap between the teeth. The penetration force is generally highest when the resultant angle is 0 degrees in both planes.

Figure 4B:
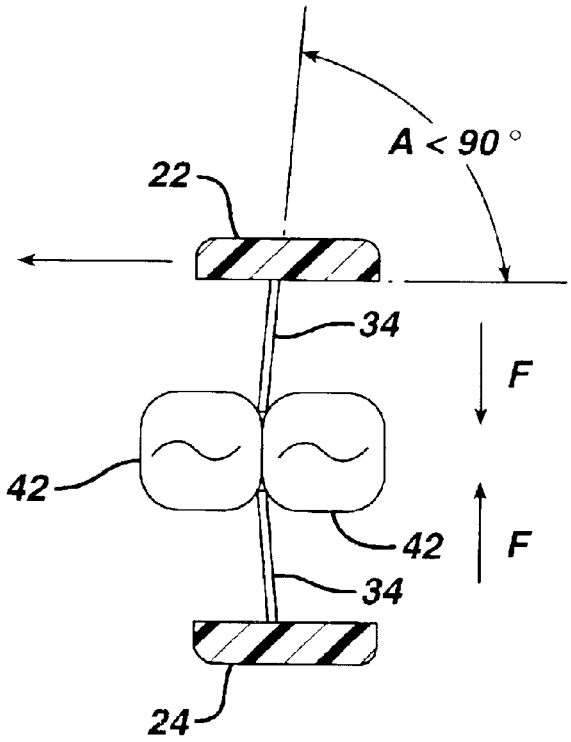
FIGS. 4B and 4C are enlarged schematic top views showing a single pair of cleaning elements during use.
Figure 4C:
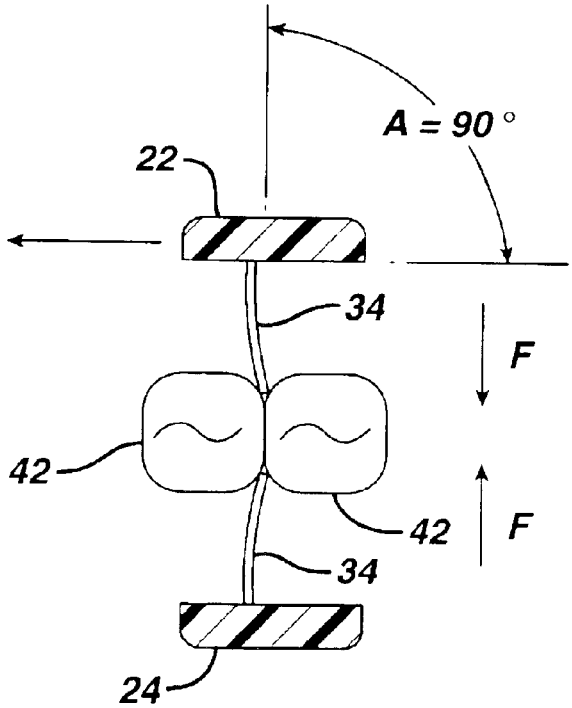

The maximum penetration force is limited by the column strength of the angled elements. Referring to FIGS. 4B and 4C, as the cleaning elements are moved across the teeth, they engage the interproximal areas as shown in FIG. 4B. As angle A approaches 90 degrees, the driving forces F increase substantially. The cleaning elements are forced into the interproximal regions until the cleaning elements can travel no further and the column strength of the elements is exceeded. The cleaning elements then buckle (FIG. 4C), and the forces F are reduced. This procedure is repeated each time the cleaning elements are moved across the teeth. Because the penetration force that could be generated by the device is much higher than the column strength of the cleaning elements, the maximum penetration force is determined by the column strength of the cleaning elements. Thus, by selecting the column strengths of the cleaning elements, the stiffness and penetration of the cleaning elements can be varied to obtain desired device properties. For example, the oral device can be provided in "soft", "medium" and "hard" models to satisfy different user preferences. Moreover, a single oral device can include cleaning elements of different column strengths. Generally, for a given material, longer, thinner cleaning elements will have lower column strength and thus less penetration than shorter, thicker cleaning elements.

The free ends of the cleaning elements of each pair are spaced apart slightly, but are sufficiently close so that at least some pairs of cleaning elements will deeply penetrate the interproximal region between two teeth when the oral device is used in the manner discussed below. As shown in FIG. 2, the free ends of the cleaning elements in the pairs that are closest to the grip are closest together, while the free ends of the cleaning elements in the pairs that are spaced further from the grip are further apart. The gap between the elements that are spaced further from the grip is larger so as to allow these elements to engage the large molars, while the spacing between the other elements is selected to allow these elements to engage the thinner teeth, e.g., incisors. The device is preferably offered in different sizes, e.g., small, medium and large, to accommodate small and large mouths. A suitable spacing is from about 0 to 4 mm for the pair that is closest to the grip, with the cleaning elements of each successive pair being spaced about 0.5 to 3 mm further apart than those of the previous pair. Thus, the cleaning elements 34 are progressively shorter as they are spaced further from grip 18. In some preferred oral devices, the cleaning elements of the pair that is closest to grip 18 are about 5 to 12 mm long, the cleaning elements of the adjacent pair are about 5to 12 mm long, and the cleaning elements of the pair that is furthest from the grip are about 5 to 9 mm long. In general, it is preferred that the shorter cleaning elements be from about 2 to 20% shorter than the adjacent cleaning elements that are closer to the grip.

Suitable cleaning elements are constructed so that they are capable of penetrating the interproximal region as shown in FIG. 4A, and removing food and debris that are trapped there. Preferably, cleaning elements 34 are bristle tufts, e.g., formed of nylon or polyester bristles. It is also preferred that the tufts that are closer to the grip include longer, inner bristles 36 that are surrounded by shorter, outer bristles 38 (see FIG. 1A). To penetrate the small gaps between the front teeth, the longer bristles 36 are relatively fine in diameter, e.g., about 0.004–0.006 inch. As a result, the longer bristles 36 typically have relatively low column strength. The outer bristles 38 are provided to support the longer bristles 36 and prevent them from buckling. Preferably, the outer bristles 38 have a diameter of from about 0.007 to 0.010 inch. If desired, a sleeve can be provided around the base of the longer bristles 36, instead of surrounding the longer bristles with shorter bristles.

The head also includes pairs of opposed centering elements 40, positioned between the cleaning elements 34 and the web 26. Centering elements 40 guide the oral device and center it around a tooth. If the device is not sufficiently centered around the tooth, only one side of the pairs of cleaning elements may engage the teeth, reducing the force with which those cleaning elements penetrate the interproximal region. Preferably, centering elements 40 are short, cylindrical bristle tufts having a relatively high stiffness. The centering elements are positioned so that, in use, at least two centering elements on each side are touching the teeth simultaneously. The head also includes a pair of angled centering elements 41. If desired, the centering elements may be elastomeric elements, e.g., knobs or fins, rather than bristle tufts, or a combination of tufts and elastomeric elements can be used.

The handle and head are both formed from a rigid or semi-rigid material, e.g., polypropylene. The handle and head may be integrally molded, or may be formed separately and joined, e.g., if it is desired to make them from different materials.

Figure 5:
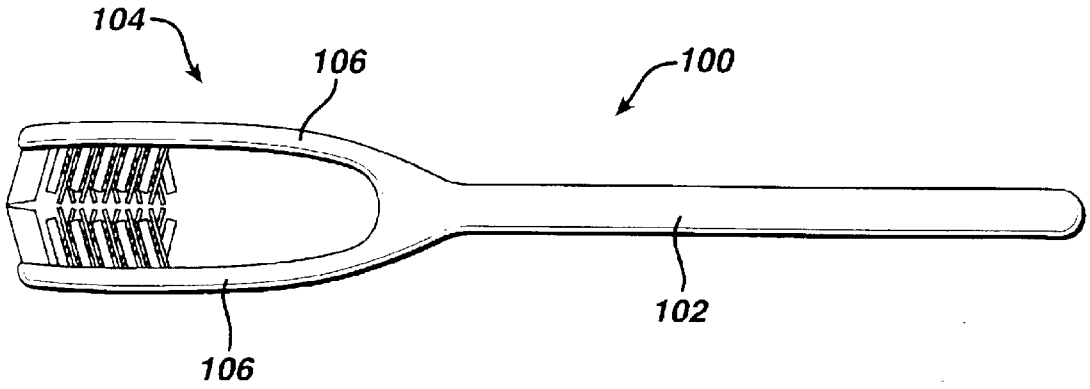
FIG. 5 is a top plan view of an oral device according to an alternate embodiment of the invention.
Figure 5A:
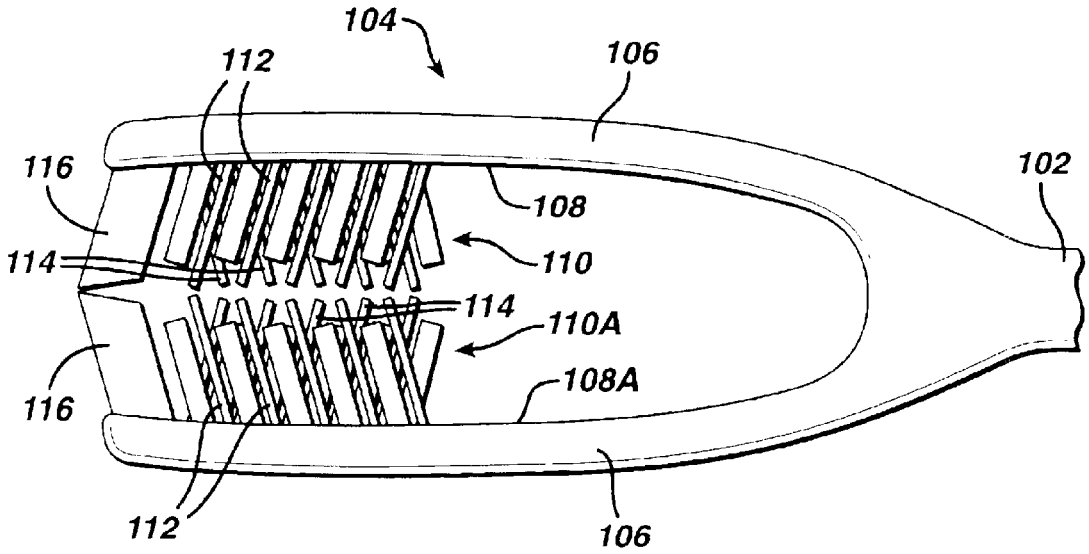
FIG. 5A is a partial enlarged view of the front portion of the device of FIG. 5.

Another oral device is shown in FIGS. 5–5A. Oral device 100 includes an elongated handle, and, extending from the handle 102, a device head 104. Device head 104 includes a pair of opposed elongated arms 106. Arms 106 may be flexible or rigid, depending on the desired properties of the device. A plurality of cleaning elements are mounted on the opposed surfaces 108, 108A of the arms, defining a pair of opposed brush heads 110, 110A. Brush heads 110, 110A include cleaning elements 112, that are angled away from the handle, cleaning elements 114, that are angled towards the handle, and a pair of closely spaced cleaning elements 116 at the forward end of the device head 104. Cleaning elements 112 and 114 may be, e.g., tufts of bristles, individual bristles, or elastomeric fins. At least some pairs of the cleaning elements are mounted at an angle, with respect to the opposed surfaces, of preferably at least 15 degrees, more preferably from 15 to 25 degrees. Device 100 may be used with a horizontal brushing motion, like a toothbrush, or with a ratcheting motion as discussed above.

Other embodiments are within the claims. For example, the oral device can include fewer or more pairs of cleaning elements. The cleaning elements can be elastomeric fins. The handle can have a shape other than disc-shaped. The cleaning elements may be angled to form a V pointing in the direction opposite to that shown in the Figures, in which case the sequence of actions of the bristles on the forward and reverse strokes of the device would be opposite to that described above. In devices that include opposed brush heads, the brush head may have any desired design, provided that at least some opposed pairs of cleaning elements are positioned and angled for interproximal penetration.

What is claimed is:

1. An oral device comprising:

a handle;

a head, extending from said handle, having a pair of elongated arms that include opposed surfaces;

a pair of opposed cleaning elements, mounted on said opposed surfaces, the cleaning elements being constructed and positioned to be inserted into a user's interproximal regions when the oral device is moved back and forth over the user's teeth, each of the cleaning elements being mounted at an acute angle relative to an interproximal line, wherein the angle relative to the interproximal line is in a plane that is substantially parallel to the chewing surface of a row of the user's teeth; and a plurality of pairs of centering elements, mounted on said opposed surfaces and positioned to guide the oral device and center it around a tooth, said centering elements comprising cylindrical bristle tufts relatively shorter than said cleaning elements.

2. The oral device of claim 1 wherein at least some of said cleaning elements are positioned to be flexed towards said opposed arms during movement in a first direction, and then straighten out until they are substantially perpendicular to said opposed surfaces during movement in a second, opposite direction.

3. The oral device of claim 1 wherein, on each of the opposed surfaces, each of the cleaning elements extends from the surface at substantially the same angle as the other cleaning elements.

4. The oral device of claim 1 wherein said pairs of cleaning elements and said opposed surfaces define a pair of opposed brush heads.

5. The oral device of claim 4 wherein said handle comprises an elongated member.

6. The oral device of claim 4 wherein the opposed cleaning elements of each pair of cleaning elements define a V-shape.

7. The oral device of claim 1 wherein said angle is greater than 10 degrees.

8. The oral device of claim 7 wherein said angle is greater than 15 degrees.

9. The oral device of claim 8 wherein said angle is from about 15 to 40 degrees.

10. The oral device of claim 1 wherein the opposed cleaning elements of each pair define a V shape.

11. The oral device of claim 1 wherein said pairs of cleaning elements are positioned along said opposed surfaces at predetermined intervals.

12. The oral device of claim 11 wherein said pairs of cleaning elements extend from the handle towards an opposite end of the head in a row.

13. The oral device of claim 12 wherein the cleaning elements are progressively shorter as the pairs are spaced further from the handle.

14. The oral device of claim 13 wherein the cleaning elements of each pair are from 2 to 20% shorter than the cleaning elements of an adjacent pair that is closer to the handle.

15. The oral device of claim 11 wherein adjacent pairs of cleaning elements are spaced from 0.5 to 6.0 mm apart lengthwise along said arms.

16. The oral device of claim 1 wherein said opposed surfaces have a predetermined depth selected to accommodate front and back teeth of a user.

17. The oral device of claim 16 wherein said depth is from about 5 to 15 mm.

18. The oral device of claim 1 wherein said handle includes a gripping portion that is constructed to be grasped between a thumb and first two fingers of a user's hand.

19. The oral device of claim 18 wherein said handle includes an elongated shaft, said head is mounted at a first end of said elongated shaft, and said gripping portion is mounted at a second end of said elongated shaft.

20. The oral device of claim 1 wherein said handle includes a substantially disc-shaped gripping portion.

21. The oral device of claim 1 wherein said head further comprises a web extending from said handle, and said opposed arms extend outwardly from opposite sides of said web.

22. The oral device of claim 21 wherein said web defines a substantially U-shaped opening that faces away from said handle.

23. The oral device of claim 21 wherein said plurality of pairs of centering elements are positioned on said opposed surfaces between said cleaning elements and said web.

24. The oral device of claim 23 wherein the centering elements are positioned so that, in use, at least two centering elements on each side are touching the teeth simultaneously.

25. The oral device of claim 23 wherein said centering elements comprise elastomeric elements.

26. The oral device of claim 23 wherein said centering elements comprise bristle tufts.

27. The oral device of claim 23 wherein said centering elements are mounted substantially perpendicular to front and back surfaces of the user's teeth.

28. The oral device of claim 21 wherein said cleaning elements are angled away from said web.

29. The oral device of claim 28 wherein said cleaning elements are positioned at an angle of about 10 to 20 degrees with respect to said web.

30. The oral device of claim 1 wherein said cleaning elements comprise bristle tufts.

31. The oral device of claim 30 wherein at least some of the cleaning elements comprise inner, relatively longer thin bristles and outer, relatively shorter and thicker supporting bristles.

32. The oral device of claim 30 wherein said bristles have a diameter of from about 0.003 inch to 0.009 inch.

33. The oral device of claim 1 wherein said cleaning elements comprise elastomeric fins.

34. The oral device, constructed to be moved horizontally over teeth of a user with a ratcheting motion, comprising:

a handle;

a head, extending from said handle, having a pair of elongated arms that include opposed surfaces;

a plurality of pairs of opposed cleaning elements, mounted on said opposed surfaces, each of the cleaning elements being mounted at an angle of greater than 15 degrees relative to an interproximal line, wherein the angle relative to the interproximal line is in a plane that is substantially parallel to the chewing surface of a row of the user's teeth;

wherein at least some of said cleaning elements are positioned and dimensioned so that, during the ratcheting motion, the elements will be flexed towards a distal end of the handle during movement in a first direction, and then straighten out until they are substantially perpendicular to said opposed surfaces during movement in a second, opposite direction; and a plurality of pairs of centering elements, mounted on said opposed surfaces and positioned to guide the oral device and center it around a tooth, said centering elements comprising cylindrical bristle tufts relatively shorter than said cleaning elements.

35. The oral device of claim 34 wherein said angle is from about 15 to 25 degrees.

36. The oral device of claim 34 wherein the opposed cleaning elements of each pair define a V shape.

37. The oral device of claim 34 wherein said pairs of cleaning elements and said opposed surfaces define a pair of opposed brush heads.

38. The oral device of claim 37 wherein said handle comprises an elongated member.

39. The oral device of claim 37 wherein the opposed elements of each of said pairs of cleaning elements defines a V-shape.

40. The oral device of claim 34 wherein said opposed surfaces have a predetermined depth selected to accommodate front and back teeth of a user.

41. The oral device of claim 40 wherein said depth is from about 5 to 15 mm.

42. The oral device of claim 34 further comprising a plurality of pairs of centering elements, mounted on said opposed surfaces and positioned to guide the oral device and center it around a tooth.

43. The oral device of claim 42 wherein the centering elements are positioned so that, in use, at least two centering elements on each side are touching the teeth simultaneously.

44. The oral device of claim 42 wherein said centering elements comprise elastomeric elements.

45. The oral device of claim 42 wherein said centering elements comprise bristle tufts.

46. The oral device of claim 42 wherein said centering elements are mounted substantially perpendicular to front and back surfaces of the user's teeth.

47. The oral device of claim 34 wherein adjacent pairs of cleaning elements are spaced from 0.5 to 6.0 mm apart lengthwise along said arms.

48. The oral device of claim 34 wherein said cleaning elements comprise bristle tufts.

49. The oral device of claim 48 wherein at least some of the cleaning elements comprise inner, relatively longer thin bristles and outer, relatively shorter and thicker supporting bristles.

50. The oral device of claim 48 wherein said bristles have a diameter of from about 0.003 inch to 0.009 inch.

51. The oral device of claim 34 wherein said cleaning elements comprise elastomeric fins.

52. A method of cleaning between the teeth of a human, comprising:

inserting into the mouth an oral device that includes (a) a handle having a first end constructed to be grasped by a user and a second, free end; (b) a head, positioned at said second end of the handle, having a pair of elongated arms, said arms being substantially parallel to each other and having opposed surfaces; (c) pairs of opposed cleaning elements, mounted on said opposed surfaces, said pairs of cleaning elements being positioned along said opposed surfaces at predetermined intervals, each of the cleaning elements being positioned at an acute angle relative to an interproximal line, wherein the angle relative to the interproximal line is in a plane that is substantially parallel to the chewing surface of a row of the user's teeth, and wherein the distance between pairs corresponds substantially to the average spacing between human teeth; and (d) a plurality of pairs of centering elements, mounted on said opposed surfaces and positioned to guide the oral device and center it around a tooth, said centering elements comprising cylindrical bristle tufts relatively shorter than said cleaning elements;

positioning the oral device so that the opposed cleaning elements straddle a row of teeth;

pushing the oral device slowly toward the back of the mouth until each pair of opposed cleaning elements is positioned between two adjacent teeth; and pulling the oral device slowly toward the front of the mouth, causing the cleaning elements to wedge into the interproximal region between the adjacent teeth.

53. An oral device comprising:

a handle;

a head, extending from said handle, having a pair of elongated arms that include opposed surfaces;

a plurality of pairs of opposed cleaning elements, mounted on said opposed surfaces, the cleaning elements being constructed and positioned to be inserted into a user's interproximal regions when the oral device is moved back and forth over the user's teeth, each of the cleaning elements being mounted at an acute angle relative to an interproximal line, wherein the angle relative to the interproximal line is in a plane that is substantially parallel to the chewing surface of a row of the user's teeth;

at least some of the cleaning elements comprising inner, relatively long thin bristles and an outer, relatively shorter supporting structure surrounding the bristles; and a plurality of pairs of centering elements mounted on said opposed surfaces and positioned to guide the oral device and center it around a tooth, said centering elements comprising cylindrical bristle tufts relatively shorter than said cleaning elements.

54. The oral device of claim 53 wherein said supporting structure comprises bristles.

55. The oral device of claim 54 wherein said inner bristles have a diameter of about 0.006 inch and said outer bristles have a diameter of about 0.007 to 0.010.

56. The oral device of claim 53 wherein said supporting structure comprises a sleeve.

57. The oral device of claim 53 wherein said inner bristles have a diameter of about 0.004 to 0.006 inch.

* * * * *

UNITED STATES PATENT AND TRADEMARK OFFICE

CERTIFICATE OF CORRECTION

PATENT NO. : 6,823,554 B1
DATED : November 30, 2004
INVENTOR(S) : Phillip M. Braun et al.

It is certified that error appears in the above-identified patent and that said Letters Patent is hereby corrected as shown below:

Title page,
Item [75], Inventor, "Duff" should be -- Duff, Jr. --.

Column 10,
Line 45, after "about" and before "0.006", insert -- 0.004 to --.

Signed and Sealed this

Fifth Day of July, 2005

JON W. DUDAS
*Director of the United States Patent and Trademark Office*